US007273110B2

(12) United States Patent
Pedersen et al.

(10) Patent No.: US 7,273,110 B2
(45) Date of Patent: Sep. 25, 2007

(54) SEALING ELEMENT FOR PIPES AND METHODS FOR USING

(76) Inventors: Dag Pedersen, Bjømsons vei 4, Narvik N-8517 (NO); Rolv Flaaten, P.O. Box 410, Abu Dhabi (AE); Mats Johansson, Frydenlundegt 44, Norvik (NO)

( * ) Notice: Subject to any disclaimer, the term of this patent is extended or adjusted under 35 U.S.C. 154(b) by 245 days.

(21) Appl. No.: 10/499,066

(22) PCT Filed: Dec. 19, 2002

(86) PCT No.: PCT/NO02/00489

§ 371 (c)(1),
(2), (4) Date: Nov. 5, 2004

(87) PCT Pub. No.: WO03/058026

PCT Pub. Date: Jul. 17, 2003

(65) Prior Publication Data

US 2005/0115707 A1 Jun. 2, 2005

(51) Int. Cl.
*E21B 23/01* (2006.01)

(52) U.S. Cl. ..... 166/387; 166/135; 166/192; 166/196; 166/217

(58) Field of Classification Search ..... 166/387, 166/192, 135, 217, 181, 196; 277/314, 323, 277/339; 138/89
See application file for complete search history.

(56) References Cited

U.S. PATENT DOCUMENTS 1,092,540 A 4/1914 Robinson
2,006,105 A * 6/1935 Maguire et al. ..... 166/135
2,247,325 A 6/1941 Wagner
4,796,707 A * 1/1989 Halbardier ..... 166/387
5,226,492 A 7/1993 Solaeche
6,513,600 B2 * 2/2003 Ross ..... 166/387
6,827,150 B2 * 12/2004 Luke ..... 166/387

FOREIGN PATENT DOCUMENTS

| | | |
|---|---|---|
| EP | 0215541 | 3/1987 |
| GB | 229520 | 7/1996 |
| GB | 2308138 | 6/1997 |
| GB | 2357536 | 6/2001 |

* cited by examiner

*Primary Examiner*—Lanna Mai
*Assistant Examiner*—Matthew J. Smith
(74) *Attorney, Agent, or Firm*—Christian D. Abel

(57) ABSTRACT

A sealing device for shutting down a pipe, comprising an expandable cylindrical sleeve (1), which is designed with a conical interior, and is provided with radially through-going slots (3) extending in the sleeve's longitudinal direction from each of the sleeve's end surfaces (4,5), with slots from opposite end surfaces being arranged between one another. A rod (2) extends through the sleeve (1), where the rod (2) is provided with a conical portion with an outside adapted to the sleeve's conical inside, and where the rod's conical portion has a smallest diameter smaller than or equal to the sleeve's smallest inner diameter in its non-expanded form and a largest diameter equal to or larger than the sleeve's largest inner diameter in its expanded form. When inserting the sealing device, the rod (2) is passed in the sleeve's (1) longitudinal direction, thus causing the rod's conical portion to come into contact with and be pressed against the sleeve's inner surface, with the result that the sleeve is expanded and comes into contact with the pipe wall.

17 Claims, 3 Drawing Sheets

SEALING ELEMENT FOR PIPES AND METHODS FOR USING

The invention relates to a sealing device for shutting down a pipe, especially suitable for shutting down a pipe in a well, and methods for inserting and removing the sealing device.

On many occasions it is desirable to shut down a pipe in a well. In oil wells, this procedure is employed in a number of cases when a shutdown is required against reservoir pressure, between different zones in the well, when acid or other liquids have to be injected, in the event of perforation of the pipe, jointing of formations or when the well has to be completely shut in.

For shutting down oil wells-it is known to use various different types of sealing devices as a part of a plug. These plugs with sealing devices are lowered into the well to the desired depth, whereupon they are activated so as to seal against pressure. In many cases these plugs can also be recovered by means of a suitable pulling tool. The common feature of such plugs is that the sealing device consists of an expandable elastic packing element, an anchoring part and a part that keeps the plug locked in an expanded position.

Before insertion in the well, an external running tool is connected to the plug. When the plug has been lowered to the desired position, the running tool is activated and an axial force is generated, which pulls on an internal rod on the plug while an external sleeve is pushed towards the plug. A relative motion is then generated between rod and sleeve, which is utilised for fastening the plug's anchoring part to the casing in the well, and for expanding the elastic sealing element against the casing. When the insertion operation is completed, the running tool is uncoupled from the plug by severing a calibrated connection between plug and running tool. This is usually achieved due to the fact that the relative force between running tool and plug exceeds the breaking strength of the connection. A locking mechanism can ensure that the anchoring element is not moved relative to the pipe wall in the well, and that the sealing element stays expanded. The plug thus remains in place in order to seal the pipe for the desired period. When removing the plug after it has performed its sealing function, a running tool is lowered which meets the top of the plug and engages with it. When it is pulled upwards, the locking mechanism can be disconnected, thus enabling the anchoring to be contracted radially, whereupon the plug can be withdrawn from the well.

When high pressure and temperatures are encountered, various types of mechanical barrier are often used round a sealing element of elastic material. This barrier may have several functions; to reduce the gap between the plug's outer diameter and the casing's inner diameter, to restrict the area of expansion of the expandable sealing material and to shield the sealing material from pressure and temperature variations. This may be necessary in order to prevent an alteration in the material characteristic of the sealing materials. When the seal is exposed to high pressure, the elastic material in the seal is pressed against the barrier. These barriers may be composed of a spring, which is cast into the sealing element, as links that are expanded axially, or as various kinds of rings or bands that can be expanded radially. If this barrier has openings, damage could occur to the sealing surface. This will be a problem particularly in the event of pressure pulses or varying temperatures. When the packer moves on account of temperature changes or pressure changes, therefore, gashes or cracks can easily occur in the elastic material, which may result in leakages.

When there is a large clearance between the casing and the plug's outer diameter, a relatively large amount of elastic sealing material has to be used in order to compensate for the volume required to fill the clearance between plug and pipe. When there is a large clearance between the casing and the plug's outer diameter, the elastic sealing material will be subjected to enormous strain on account of the relatively large variation that exists between the expanded and non-expanded shape. In addition, as mentioned earlier metallic extrusion barriers are used, which have to be expanded in the same way. Under the influence of temperature, elastic materials may also behave in such a manner that they will be capable of flowing out through any splits in the barrier. In many cases the elastic element will also undergo changes, resulting in cracking of the material over the course of time. This may give rise to leakages. In addition, over the course of time a permanent deformation will occur in the sealing element, which may make is difficult to withdraw the plug from the well, since the sealing element does not return to its original diameter.

Examples of this type of plug with substantially an elastic sealing material and barriers are disclosed in patents GB 2 308 138A, EP A2 155 413, U.S. Pat. No. 5,226,492 and GB 2 296 520 A.

In U.S. Pat. No. 2,247,325 a slightly different type of packing element is disclosed comprising a conical rod, which pushes the packing element outwards and into engagement with a casing. U.S. Pat. No. 1,092,540 describes a packer consisting of separate conical packing elements, which, when pushed together, are pressed outwards into engagement with a casing.

The object of the present invention is to achieve a sealing device, which is particularly suitable for use in a well, which is resistant to high pressure and temperatures and possibly also an acid environment, which avoids the problem of sealing material changing from an elastic to a brittle material and cracking during use, and which avoids the problem of permanent deformation of an elastic material, which creates problems if the sealing device has to be removed.

The object is achieved with a sealing device for shutting down a pipe and methods for inserting and removing a sealing device according to the invention, where the characterising features of the sealing device and methods for inserting and removing the sealing device are indicated in the accompanying claims.

A sealing device according to the invention is particularly suitable for use in a well, but may also be employed in other types of pipes. A sealing device according to the invention for shutting down a pipe comprises an expandable cylindrical sleeve, which is designed with a conical interior. The sleeve is provided with radially through-going slots extending in the sleeve's longitudinal direction from each of the sleeve's end surfaces, with slots from opposite end surfaces being arranged between one another and creating a sleeve in a meandering form. The sealing device further comprises a rod extending through the sleeve. The rod is provided with a conically shaped portion, the outside of which is adapted to the conical inside of the sleeve. The rod's conical portion has a smallest diameter smaller than or equal to the sleeve's smallest inner diameter in its non-expanded form and a largest diameter equal to or larger than the sleeve's largest inner diameter in its expanded form. When inserting the sealing device, the rod is passed in the sleeve's longitudinal direction so that the conical portion of the rod comes into abutment against the sleeve's inner surface and expands the sleeve with the result that it comes into abutment against the pipe wall.

The invention will now be described in greater detail with reference to accompanying drawings, which illustrate an embodiment, in which.

Corresponding elements have been given identical reference numerals in all the figures.

Figure 1:
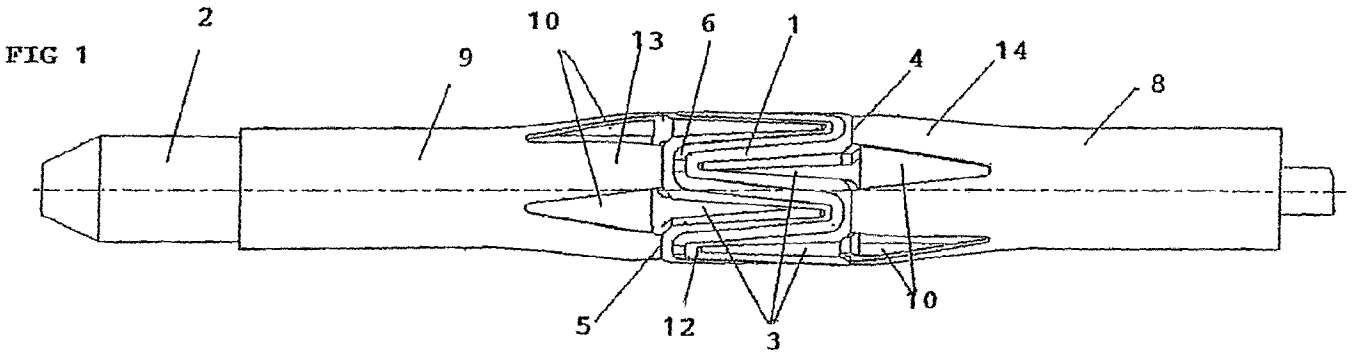
FIG. 1 illustrates the sealing device in expanded form.
Figure 3:
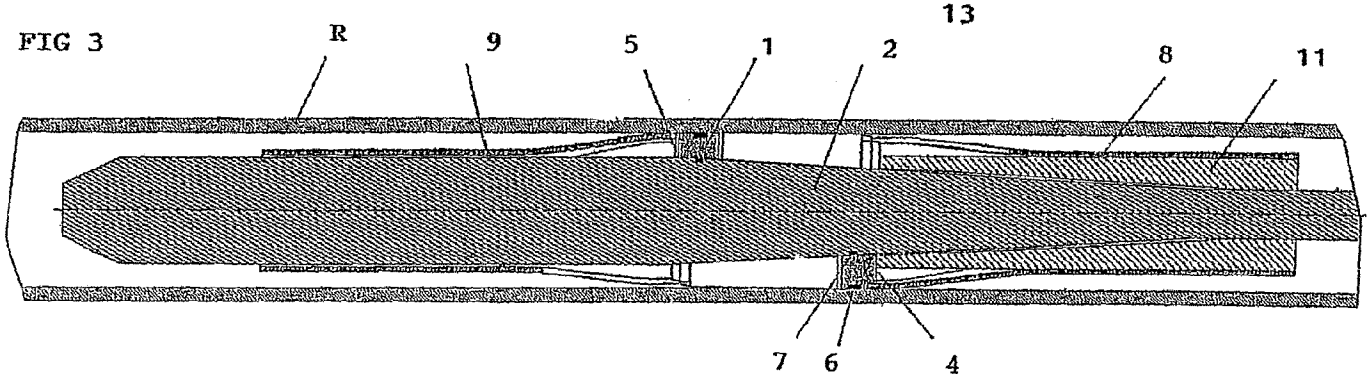
FIG. 3 is a section along the sealing device's longitudinal axis of the sealing device in expanded form located in a pipe.

A sealing device according to the invention comprises an expandable cylindrical sleeve 1. The sleeve is designed with an inner conical surface and provided with radially through-going slots 3 extending in the sleeve's longitudinal directions from each of the sleeve's end surfaces 4,5, with slots from opposite end surfaces being arranged between one another. This gives the sleeve a meandering form in its circumference. The sealing device further comprises a rod 2 extending through the sleeve's 1 inner cavity. The length of the rod is preferably at least twice the length of the sleeve in the longitudinal direction. The rod 2 is provided with a conically shaped portion, with an outside adapted to the conical inside of the sleeve, where the conical portion of the rod has a smallest diameter smaller than or equal to the sleeve's smallest inner diameter in its non-expanded form and a largest diameter equal to or larger than the sleeve's largest inner diameter in its expanded form. The rod's conical portion may, for example, be a conical portion machined in the rod by milling, turning or the like or a conically shaped part mounted on the rod. When inserting the sealing device, the rod 2 is passed in the sleeve's 1 longitudinal direction, thus causing the conical portion of the rod to come into abutment against the sleeve's inner surface and expand the sleeve so that it comes into engagement with the pipe wall. A force may be applied to the rod that is sufficient to cause plastic deformation of the sleeve, but not sufficient to cause a rupture in the sleeve material.

The sealing device may be inserted in a pipe R in a well by applying a compressive or tensile force to the rod. If the sealing device has to be inserted by the application of compressive forces, the running tool may, for example, comprise a striking tool. In this case the sealing device is inserted in such a manner that the end of the rod 2 where the conical portion has the largest diameter is facing the running tool. The rod's conical surface will be pushed into the sleeve 1 and expand it until the desired force is applied to the sleeve and the sealing device withstand the desired pressure. Alternatively, the sealing device may be inserted by applying a tensile force to the rod. In this embodiment the narrow end of the rod's conical portion will be facing a running tool. The running tool will exert a tensile force on the rod, thus achieving the desired direct action and a secure frictional connection between sleeve and pipe wall. A low-friction coating may be applied to the outside and inside respectively of the rod and the sleeve in order to facilitate the insertion of the conical part of the rod in the sleeve. Running tools for inserting sealing devices in pipes in different manners are known and do not form any part of the present invention and therefore receive no further mention.

Tests have been carried out with a model of a sealing device according to the invention. The test was carried out with a model of the sealing device on the scale 1:1 and comprised an expandable sleeve and a rod with a conical surface for expansion of the sleeve. These were placed in a pipe with an inner diameter larger than the sleeve's outer diameter in a non-expanded form. The sleeve was manufactured in an expanded form, which will be explained in greater detail below. The material in the model's conically shaped sleeve and rod was ST-52, which is steel with yield strength of approximately 320 $N/mm^2$, a breaking point between 500-600 $N/mm^2$ and an elongation at break of approximately 21%. The angle of the conical area of the rod in the model was 1:10. During the test a hydraulic piston was employed and 1.0 ton (2204 lb) was applied to the rod in order to expand the sleeve. The rod was then pushed into the sleeve with a force of 20 tons (44093 lb). On the application of such a force on the sealing device, sleeve and rod were secure in the pipe due to frictional forces and the pipe was sealed against water penetration. The rod was then pushed out of contact with the sleeve by applying a force of 10 tons (22046 lb). After the rod had been pushed away from the sleeve, the sleeve was pushed through an outer pipe with an internal conical area with an angle 1:13. During the test a hydraulic piston was employed and a force of 1.0 ton (2204 lb) was applied in order to compress the sleeve to a non-expanded diameter.

Figure 2:
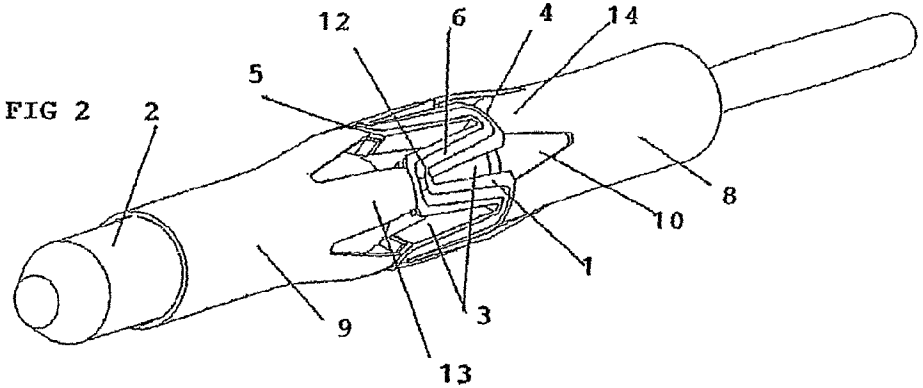
FIG. 2 is a perspective view of what is illustrated in FIG. 1.
Figure 2B:
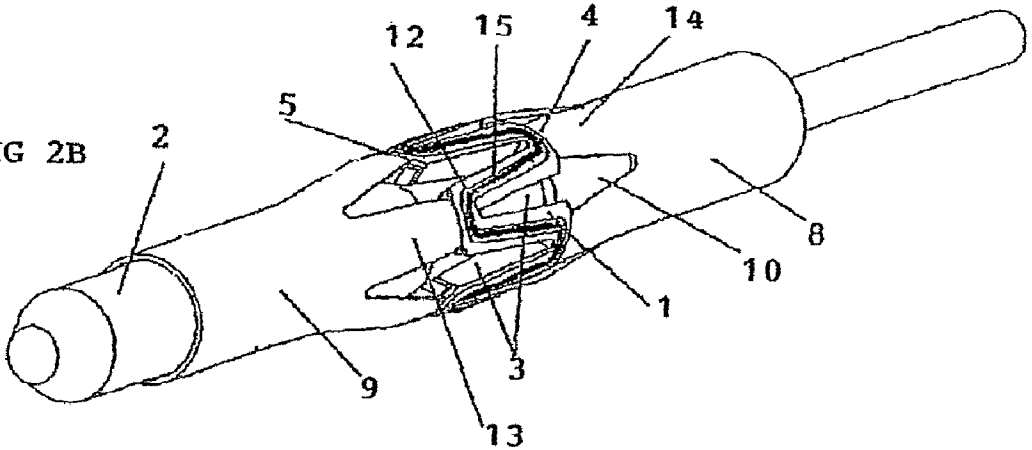
FIG. 2B is a perspective view similar to FIG. 2 of another embodiment.

In a preferred embodiment of the sealing device the sleeve 1 may be provided in its outer surface with devices that ensure a tight seal, preferably one or more grooves 6 for one or more sealing elements. The groove and sealing element are advantageously Continuous in the sleeve's circumference in order to ensure a tight sealing device after inserting the sealing device in a pipe. In an alternative embodiment the sleeve may be provided in its outer surface with outwardly protruding ribs 15, as shown in FIG. 2B, which, when the sleeve comes into abutment against the pipe wall, lead to a small local deformation of the pipe wall and the rib, thereby creating a tight connection between the sleeve and the pipe wall. These outwardly projecting ribs are also advantageously continuous about the sleeve's circumference. Both groove with sealing element and outwardly projecting ribs are designed in such a manner that they do not cause any major problems if the sealing device has to be removed, when the sleeve is radially compressed.

In order to ensure a tight connection between the sleeve and the rod's conical surface, the sleeve may be provided in its inner surface with one or more grooves for a sealing element. In this case groove and sealing element are also advantageously continuous in the circumference of the rod, and the inner surface of the sleeve. Sealing between rod and sleeve may also be achieved by applying a coating externally on the rod's conical portion, or alternatively the sleeve's internal conical surface. This coating may be of a softer material, thus enabling it to fill any gaps or spaces between sleeve and rod. Sealing can also be achieved by means of direct metallic contact between sleeve and rod. A person skilled in the art will appreciate that a tight connection between rod and sleeve can be achieved in a number of alternative ways.

In a preferred embodiment, devices that ensure a tight seal, preferably groove 6 for locating a sealing element have a width representing a maximum of 80%, but most preferred under 50% of the sleeve's width from the inner point of a slot 12 to the opposite end surface of the sleeve. These percentages are intended as guidelines for designing the sleeve, but are not absolute. Preferred ratios will vary with the type of material employed in the sleeve and the conditions under which the sealing device has to operate. What is important is that the width of the sleeve from the groove in the sleeve to the sleeve's end edge is of such an extent that the sealing material in the groove is effectively shielded from the influence of pressure variations. A ratio of this kind between the length of the sleeve and that of the sealing element also ensures that any deformations of the sealing device will be substantially absorbed in the sleeve and not in the sealing element. This guarantees stability in the sealing device sealing properties. Since the seating material constitutes a minor part of the sealing device's outer surface, this also avoids problems due to permanent deformation of the sealing material when the sealing device is removed once it has completed its intended purpose.

In a preferred embodiment of a sealing device according to the invention the sleeve 1 is manufactured by machining a pipe, with an outer diameter larger than the sleeve's outer diameter into a non-expanded form. Machining should be understood to refer amongst other things to the removal of material from the pipe in order to form an inner conical surface and slots 3 in the sleeve, by means of, for example, milling, turning, sawing or the like, and other machining in order to form a sleeve according to the invention. Following the machining, the sleeve 1 may be compressed. With a force that creates plastic deformation into a non-expanded form. Alternatively, the sleeve 1 may be compressed by applying an external pipe, which keeps the sleeve 1 compressed, where the sleeve 1 in the non-expanded form of the sleeve is compressed to an outer diameter that makes it possible to have the sleeve 1 located in a desired position in a pipe R in a well. This may be a diameter that is smaller than the pipe R since, in order to be located in the desired position, the sealing device may possibly have to be passed through equipment previously located in the well such as valves, sensors or the like, which may have a smaller inner diameter than the pipe.

Figure 3B:
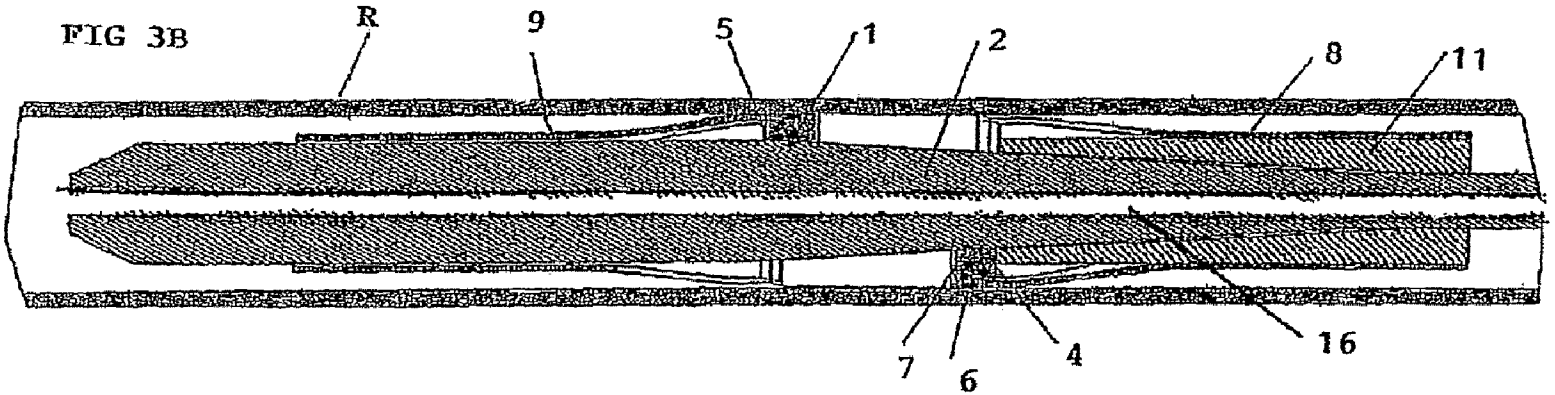
FIG. 3B is a section similar to FIG. 3, of another embodiment.
Figure 4:
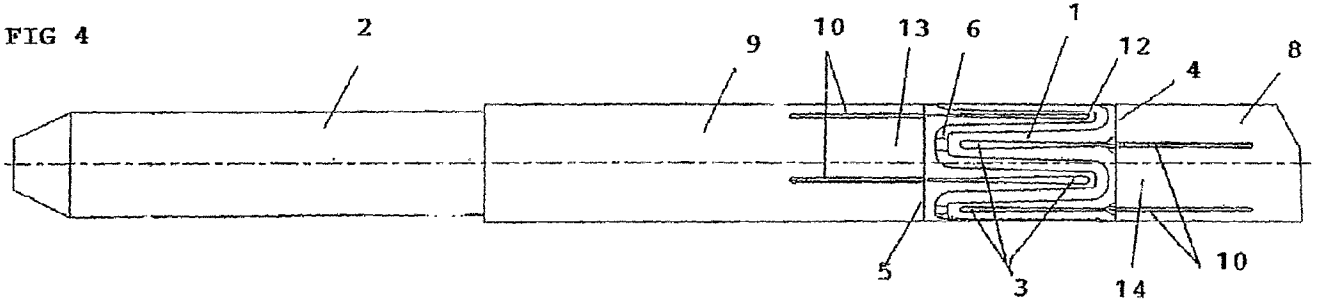
FIG. 4 illustrates the sealing device in a non-expanded form before insertion in a pipe.
Figure 5:
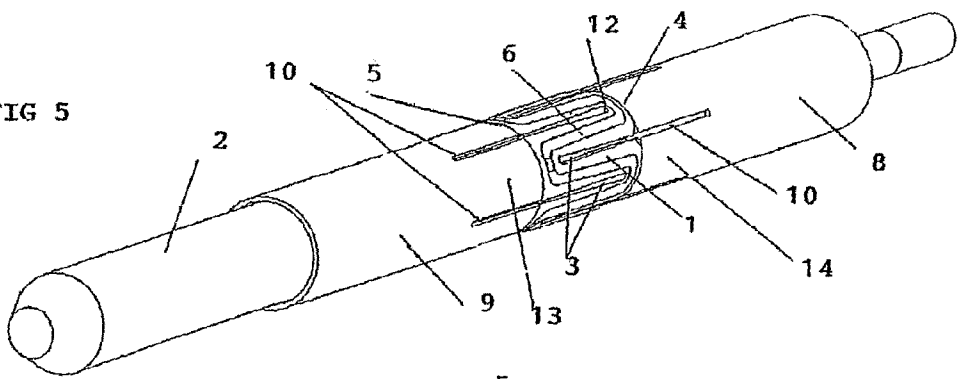
FIG. 5 is a perspective view of what is illustrated in FIG. 4.
Figure 6:
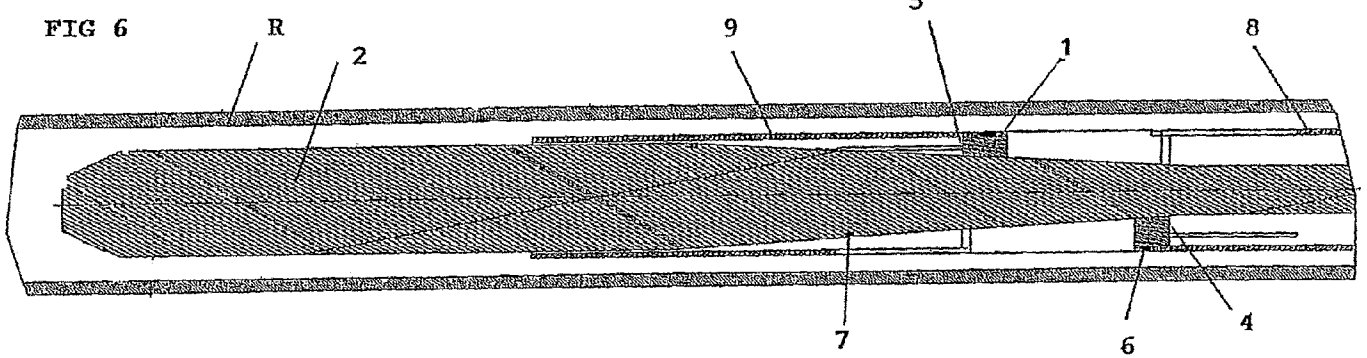
FIG. 6 is a section along the sealing device's longitudinal axis of the sealing device in a non-expanded form located in a pipe.

In an embodiment, as shown in FIG. 3B, of the sealing device the rod 2 may be designed with at least one bore 16 in its longitudinal direction. In such an embodiment the sealing device may be employed in connection with production from or shutdown of zones in a well. Well fluid or other equipment may then be passed through the sealing device through the bore in the rod. In an embodiment where the rod has no bore in its longitudinal direction, the sealing device may act as a production packer.

According to an embodiment the sealing device may further comprise a first support sleeve 8 with an inner diameter approximately equal to the rod's largest diameter, and comprising an end portion 14 facing and attached to the sleeve's first end 4. The first support sleeve's 8 end portion 14 is designed with radially through-going slots 10 extending in the first support sleeve's 8 longitudinal direction. The slots 10 in the first support sleeve 8 are arranged in the extension of the sleeve's slots 3, which extend from the sleeve's first end 4. The sealing device further comprises a second support sleeve 9 of similar design to the first support sleeve 8, but oppositely directed and where an end portion 13 is facing and attached to the sleeve's second end 5. The second support sleeve's 9 end portion 13 is also designed with radially through-going slots 10 extending in the second support sleeve's 9 longitudinal direction and where the slots 10 in the second support sleeve 9 are arranged in extension of the sleeve's slots 3, which extend in the sleeve's 1 longitudinal direction from the second end 5. In this embodiment the sealing device also comprises a guide 11, which is arranged between the first support sleeve 8 and the rod 2, and has an inner conical surface, where, during insertion of the sealing device, the guide's 11 inner conical surface abuts against the narrow part of the rod's 2 conical portion.

The individual elements in a sealing device according to the invention have now been described. A schematic description will be given below of a method for inserting and removing the sealing device.

A preferred method for inserting a sealing device according to the invention comprises the following steps. The sealing device in a non-expanded form is attached to a running tool, whereupon the running tool with the sealing device is passed to the desired position in the well. At the desired position in the well, the running tool is secured in relation to the pipe wall. By means of the running tool the rod 2 is then passed in the sleeve's 1 longitudinal direction, thus causing the sleeve 1 to be expanded and come into abutment against the pipe wall, the connection between sealing device and running tool being broken by the application of a predefined power transmission from the running tool to the sealing device. The sealing device is thereby attached to the pipe wall with a frictional connection, whereupon the running tool is withdrawn from the pipe.

In the method for removing a plug according to the invention, a running tool is lowered to the sealing device in the well and affixed thereto. The running tool then applies a force to the rod 2, with the result that the rod 2 is moved out of abutment against the sleeve 1. Furthermore, an axial force is applied to the sleeve 1, resulting in a radial compression of the sleeve 1 to an outer diameter, which enables the sleeve 1 to be withdrawn from the well. A radial compression of this kind can be achieved by an outer pipe being pressed down over the sleeve 1 in the sealing device, but a person skilled in the art will understand that this can be done in other ways. After the sleeve has been compressed, the sealing device with the running tool are withdrawn from the pipe.

The invention has now been described by means of embodiments. With regard to the embodiment, a number of variations and modifications may be envisaged within the scope of the invention as it is defined in the following claims. For example, the sleeve 1 may be designed with outer ribs in its surface for increased friction between pipe wall and sealing device, thereby offering greater resistance to movement of the sealing device in the pipe's longitudinal direction. A sealing device according to the invention may have a number of areas of application; it may be used for shutdown of a well or a pipeline, it may be used in all kinds of plugs, be it plugs that have to be capable of being removed or only pushed down into the well after use or permanent plugs. The sealing device according to the invention may also be used for shutdown of individual zones in a well, while fluid is flowing through a pipe in the extension of the bore in the sealing device according to the invention. This may be done, for example, where parts of a casing are damaged. Several sealing devices according to the invention may be placed one after the other at desired intervals, thus permitting fluid shutdown between the sealing devices, while well fluid is passed through the rod. The sealing device according to the invention may also be envisaged employed for securing an extension pipe to the casing in the production zone. In this case the sealing device will be an integrated part of the anchoring. The sealing device may also be used to close off fluid and pressure between production tubing and casing.

The invention claimed is:

1. A sealing device for shutting down a pipe, comprising an expandable cylindrical sleeve, which is designed with a conical interior, and a rod extending through the cylindrical sleeve, where the rod is provided with a conical portion with an outside adapted to the sleeve's conical inside and with a smallest diameter smaller than or equal to the sleeve's smallest inner diameter in its non-expanded form and a largest diameter equal to or larger than the sleeve's largest inner diameter in its expanded form, where, when inserting the sealing device, the rod is passed in the cylindrical sleeve's longitudinal direction, thus causing the rod's conical portion to come into contact with and be pressed against the cylindrical sleeve's inner surface, with the result that the cylindrical sleeve is expanded and comes into contact with the pipe wall,
characterised in that the cylindrical sleeve is provided with radially through-going slots extending in the sleeve's longitudinal direction from each of the cylindrical sleeve's end surfaces, with slots from opposite end surfaces being arranged between one another.

2. A sealing device according to claim 1, characterised in that the sealing device further comprises a first support sleeve with an inner diameter approximately equal to the rod's largest diameter, and comprising an end portion facing and attached to the cylindrical sleeve's first end, where the end portion is designed with radially through-going slots extending in the first support sleeve's longitudinal direction, where the slots in the first support sleeve are arranged in the extension of the cylindrical sleeve's slots, a second support sleeve with an inner diameter approximately equal to the rod's largest diameter, and comprising an end portion facing and attached to the cylindrical sleeve's second end, where the end portion is designed with radially through-going slots extending in the second support sleeve's longitudinal direction, where the slots in the second support sleeve are arranged in extension of the cylindrical sleeve's slots, and a guide, which is arranged between the first support sleeve and the rod, and has an inner conical surface, where, during insertion of the sealing device, the guide's inner conical surface abuts against the narrow part of the rod's conical portion.

3. A sealing device according to claim 2, characterised in that the cylindrical sleeve's outer surface is provided with one or more grooves for one or more sealing elements.

4. A sealing device according to claim 3, characterised in that the rod's conical portion and/or the cylindrical sleeve's inner surface is provided with one or more grooves for one or more sealing elements.

5. A sealing device according to claim 4, characterised in that the grooves for locating the sealing elements have a width representing a maximum of 80%, preferably less than 50% of the cylindrical sleeve's width from inner point of a slot to the opposite end surface of the cylindrical sleeve.

6. A sealing device according to claim 5, characterised in that the cylindrical sleeve is manufactured by machining a pipe that has an outer diameter larger than the cylindrical sleeve's outer diameter in a non-expanded form, with subsequent radial compression.

7. A sealing device according to one of the claims 1-6, characterised in that the cylindrical sleeve is provided with outwardly projecting ribs in its outer surface.

8. A sealing device according to one of the claims 1-6, characterised in that the rod has at least one through-going bore in its longitudinal direction.

9. A sealing device according to claim 8, characterised in that the cylindrical sleeve is provided with outwardly projecting ribs in its outer surface.

10. A method for inserting a sealing device according to one of the claims 1-6, characterised by the following steps:

a) the sealing device in non-expanded form is attached to a running tool,
b) the running tool with the sealing device are passed to the desired position in the well,
c) the running tool is held in the correct position in relation to the pipe wall,
d) by means of the running tool, the rod is passed in the sleeve's longitudinal direction, thus causing the sleeve to be expanded and come into abutment against the pipe wall, and thereby be attached to the pipe wall with a frictional connection, the connection between sealing device and running tool being broken by the transmission of a desired force from the running tool to the sealing device,
e) the running tool is withdrawn from the pipe.

11. A method according to claim 10, characterized in that the cylindrical sleeve is provided with outwardly projecting ribs in its outer surface.

12. A method according to claim 10, characterized in that the rod has at least one through-going bore in its longitudinal direction.

13. A method according to claim 12, characterized in that the cylindrical sleeve is provided with outwardly projecting ribs in its outer surface.

14. A method for removing a sealing device according to one of the claims 1-6, characterised by the following steps:

x) a running tool is lowered to the sealing device in the well and affixed thereto,
y) the running tool applies a force to the rod, with the result that the rod is moved out of abutment against the cylindrical sleeve,
z) an axial force is then applied to the cylindrical sleeve, resulting in a radial compression of the cylindrical sleeve,
v) the sealing device with the running tool are withdrawn from the pipe.

15. A method according to claim 14, characterized in that the cylindrical sleeve is provided with outwardly projecting ribs in its outer surface.

16. A method according to claim 14, characterized in that the rod has at least one through-going bore in its longitudinal direction.

17. A method according to claim 16, characterized in that the cylindrical sleeve is provided with outwardly projecting ribs in its outer surface.

* * * * *